US006767220B2

(12) United States Patent
Wilson et al.

(10) Patent No.: US 6,767,220 B2
(45) Date of Patent: Jul. 27, 2004

(54) SYSTEMS AND METHODS FOR INTERCONNECTING ELECTRONIC COMPONENTS

(75) Inventors: Jeremy Ian Wilson, Rocklin, CA (US); Andrew Harvey Barr, Roseville, CA (US); Stephan Karl Barsun, Auburn, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/671,647

(22) Filed: Sep. 25, 2003

(65) Prior Publication Data

US 2004/0106305 A1 Jun. 3, 2004

Related U.S. Application Data

(63) Continuation of application No. 10/308,533, filed on Dec. 3, 2002, now Pat. No. 6,676,417.

(51) Int. Cl.[7] ..... H01R 12/00

(52) U.S. Cl. ..... 439/67; 439/493; 439/362; 439/364

(58) Field of Search ..... 439/67, 493, 362, 439/364, 329, 492

(56) References Cited

U.S. PATENT DOCUMENTS

| | | | | | |
|---|---|---|---|---|---|
| 4,770,645 | A | * | 9/1988 | Antes | 439/329 |
| 5,133,667 | A | * | 7/1992 | Daughtrey | 439/67 |
| 5,716,229 | A | * | 2/1998 | Loder et al. | 439/493 |
| 5,730,619 | A | * | 3/1998 | Hamlin | 439/493 |
| 6,095,840 | A | * | 8/2000 | Yamaguchi et al. | 439/247 |
| 6,309,223 | B1 | * | 10/2001 | Wolfe | 439/67 |
| 6,537,082 | B2 | * | 3/2003 | Hopfer et al. | 439/67 |
| 6,592,380 | B2 | * | 7/2003 | Miyazawa et al. | 439/67 |

* cited by examiner

*Primary Examiner*—Tho D. Ta

(57) ABSTRACT

System for electrically interconnecting components are provided. One such system comprises: a flex cable having a first end and a second end; a first connector attached to a electrically communicating with the first end of the flex cable; a second connector attached to and electrically communicating with the second end of the flex cable; and a first retention member extending outwardly from the flex cable.

13 Claims, 5 Drawing Sheets

SYSTEMS AND METHODS FOR INTERCONNECTING ELECTRONIC COMPONENTS

This application is a continuation of Ser. No. 10/308,533 filed Dec. 3, 2002, now U.S. Pat. No. 6,676,417.

BACKGROUND

Flexible circuit assemblies ("flex circuits") are commonly used to make connections between electronic components, such as printed circuit boards (PCBs). In many applications that use flex circuits to interconnect PCBs, such as within a computer chassis, there is often a need to disconnect the flex circuit from the PCBs. By way of example, a flex circuit is disconnected from a PCB when the PCB is to be removed from the chassis for servicing. After servicing, the PCB is returned to the chassis and is reconnected to the flex circuit. Unfortunately, connecting and/or disconnecting the flex circuit can be difficult. For instance, if the PCB, flex circuit and adjacent components are located too close together, it may be difficult for an operator to access the flex circuit. More specifically, there may be insufficient clearance within a chassis for the hand of an operator to be able to grasp and manipulate the flex circuit and/or PCB.

SUMMARY

An embodiment of a system comprises a flex circuit assembly, a support structure and a printed circuit board (PCB). The flex circuit assembly has a flex cable, a first connector and a retention member. The first connector is attached to and electrically interconnected with a first end of the flex cable, and the retention member extends outwardly from the flex cable. The support structure defines an orifice and has an anchor, the orifice being sized and shaped to receive the retention member such that a portion of the retention member can be inserted into the orifice to form an interference fit, thereby mechanically supporting the flex circuit assembly. The PCB has a second connector and a shaft, the second connector being sized and shaped to electrically interconnect with the first connector. The shaft is rotatably mounted to the PCB and has a distal end configured to engage the anchor of the support structure such that, as the distal end of the shaft engages the anchor and the shaft is rotated, the second connector is aligned with and moved toward mating engagement with the first connector.

Another embodiment of a system comprises: a flex cable having a first end and a second end; a first connector attached to and electrically communicating with the first end of the flex cable; a second connector attached to and electrically communicating with the second end of the flex cable; and a first retention member extending outwardly from the flex cable, the first retention member having a post and a cap, the post having a first end located adjacent to the flex cable and as second end to which the cap is attached, the cap including multiple segments, each of which extends outwardly from the second end of the post, each of the segments being deflectable toward the post in response to a biasing force.

Another embodiment of a system comprises: a chassis having an anchor; a flex circuit assembly sized and shaped to be mounted at least partially within the chassis, the assembly having a flex cable, a first connector, the first connector being attached to and electrically interconnected with a first end of the flex cable; and an electronic component sized and shaped to be mounted at least partially within the chassis, the electronic component having a second connector and a shaft, the second connector being sized and shaped to electrically interconnect with the first connector of the flex circuit assembly, the shaft being rotatably mounted to the electronic component and having a distal end configured to engage the anchor of the chassis such that, as the distal end of the shaft engages the anchor and the shaft is rotated, the second connector is aligned with and moved toward mating engagement with the first connector.

Another embodiment of a system for electronically interconnecting components comprises a flex cable having a first end and a second end; a first connector attached to and electrically communicating with the first end of the flex cable; a second connector attached to and electrically communicating with the second end of the flex cable; and a means for supporting the first end of the flex cable such that the first connector is positioned for electrically engaging a first of the components.

An embodiment of a method for electrically interconnecting components comprises: providing a flex cable having a connector attached to a first end thereof; providing a support structure; and forming an interference fit between the support structure and a portion of the flex cable such that the first end of the flex cable is supported by the support structure.

DETAILED DESCRIPTION

Systems and methods described herein potentially enable electrical connections between flex circuits and electronic components to be made at locations that are difficult for operators to reach. By way of example, some embodiments accommodate electrical interconnecting of components that may be located in an area of insufficient clearance for an operator to conveniently grasp and/or position a flex circuit and/or component.

Figure 1:
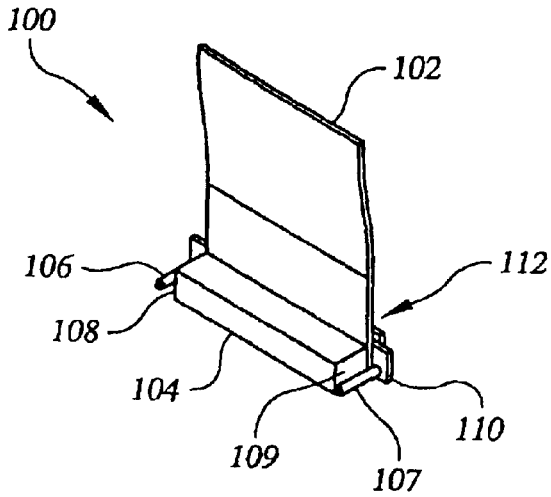
FIG. 1 is a partially cut-way, perspective view of an embodiment of a flex circuit assembly.

As shown in FIG. 1, an embodiment of a flex circuit assembly 100 includes a flex cable 102. For ease of illustration, only a portion of the flex cable is shown in FIG. 1. Flex cable 102 is attached to a connector 104 at one of its ends, with another connector (not shown) typically being attached at the other of its ends. Connector 104 is sized and shaped to mate with a corresponding connector of a component, such as a circuit assembly, e.g., a printed circuit board (PCB), so that the component can electrically communicate with the flex cable. Similarly, the other end of the flex cable and corresponding connector are configured to electrically communicate with another component so that the components attached to the flex cable can electrically communicate with each other. Various types of connectors, e.g., a fine pitch, surface mount compatible connector, such as a "Mictor" series connector manufactured by Tyco, can be used.

In the embodiment depicted in FIG. 1, guide posts 106 and 107 are mounted adjacent to opposing end walls 108, 109 of the connector. The guide posts 106 and 107 are sized and shaped to be received within corresponding orifices (not shown) of a mating connector, which typically is attached to the component to which the flex cable is to be connected. The guide posts assist in aligning the connector of the flex cable with the connector of the component so that the connectors can electrically communicate with each other. Clearly, various shapes, sizes and numbers of guide posts can be used. In some embodiments, guide posts may even be omitted.

A bolster plate 110 that supports guide posts 106, 107 is located at end 112 of the flex cable, with the bolster plate 110 and the connector 104 being positioned on opposite sides of the flex cable. In addition to supporting the guide posts, the bolster plate 110 supports, e.g., stiffens, the flex cable so that the flex cable is more resistant to bending. This tends to improve the integrity of the solder joints that typically are used to attach the flex cable 102 to the connector 104.

Figure 2:
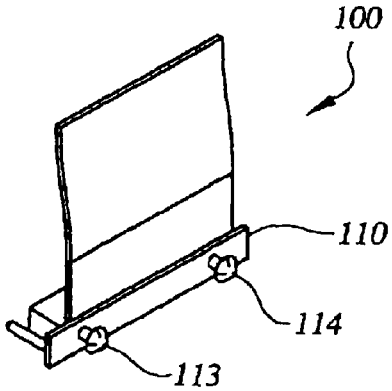
FIG. 2 is a partially cut-way, perspective view of the embodiment of the flex circuit assembly of FIG. 1, showing the rear of the flex circuit assembly.

As shown more clearly in FIG. 2, retention members 113 and 114 are supported by and extend outwardly from the bolster plate 110. Retention members can, however, be attached to a flex circuit assembly in various manners. By way of example, retention members can be directly adhered to a flex circuit assembly, such as with high strength adhesive. Alternatively, one or more mechanical fasteners can be used. For instance, fasteners can be inserted through a flex cable to clamp the retention members to the flex cable. Clearly, any fastener that extends through a flex cable should be positioned so that the fastener does not interfere with internal circuitry/conductors of the flex cable.

Figure 3:
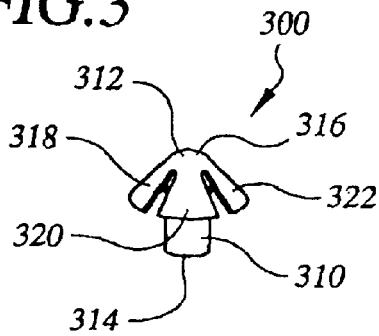
FIG. 3 is a perspective view of an embodiment of a retention member.

In FIG. 3, an embodiment of a retention member 300 is shown that includes a post 310 and a cap 312. Post 310 is generally cylindrical in shape and extends from a first end 314, which attaches to a bolster plate (not shown in FIG. 3). The second end 316 is attached to cap 312. Cap 312 includes multiple segments, the ends of which are movable toward the post 310. Specifically, the embodiment of the cap of FIG. 3 includes four segments (segments 318, 320 and 322 of which are shown), each of which is generally triangular in shape. The apex of each segment is attached in a vicinity of the second end 316 of the post.

Since only the apex of each segment is fixed to the post 310, the base of each segment can be deflected toward the post. For example, segments can be deflected inwardly toward the post as the cap is inserted through an orifice that has a smaller diameter than that of the cap. After being inserted into such an orifice, continued insertion of the retention member can enable the segments to return to their unbiased positions so that an interference fit is formed with the structure defining the orifice.

Figure 4:
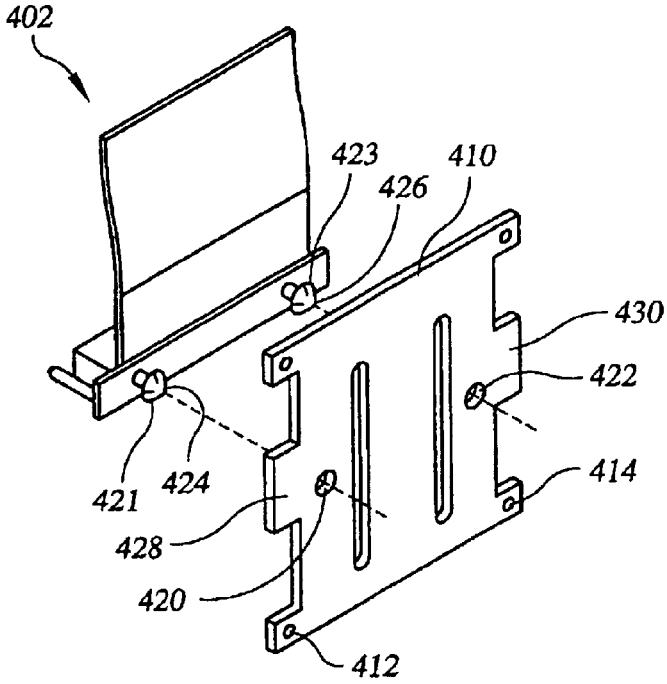
FIG. 4 is a partially cut-away, perspective view of the embodiment of the flex circuit assembly of FIG. 1 aligned with a support structure.

Referring now to FIG. 4, mounting of an embodiment of a flex circuit assembly 402 to a support structure 410 will be described. In FIG. 4, a support structure 410 is depicted that is generally configured as a plate. Support structure 410 can be a portion of a chassis or other component that is adapted to mount the flex circuit assembly. In the embodiment depicted in FIG. 4, support structure 410 includes holes 412 and 414 that are used to receive mechanical fasteners for mounting the support structure to a chassis.

Support structure 410 also includes mounting holes 420 and 422, each of which is adapted to receive a retention member of the flex circuit assembly 402. Specifically, hole 420 is adapted to receive retention member 421, and hole 422 is adapted to receive retention member 423.

As the respective caps 424, 426 of the retention members 421, 423 are directed through the holes 420, 422, the segments of the caps are deflected inwardly toward their respective posts. Once inserted through the holes, the segments return to their unbiased positions and form interference fits with the support structure 410 so that the flex circuit assembly 402 is mounted to the support structure as shown in FIG. 5.

Note that the holes can vary in size so that, in some embodiments, the flex circuit assembly is able to move or "float" in a limited manner, while still maintaining the interference fit. This is particularly useful in applications where components are to be blind-mated, since it is often required that at least one of the components is able to float in order to compensate for manufacturing dimensional tolerances, for example.

Figure 5:
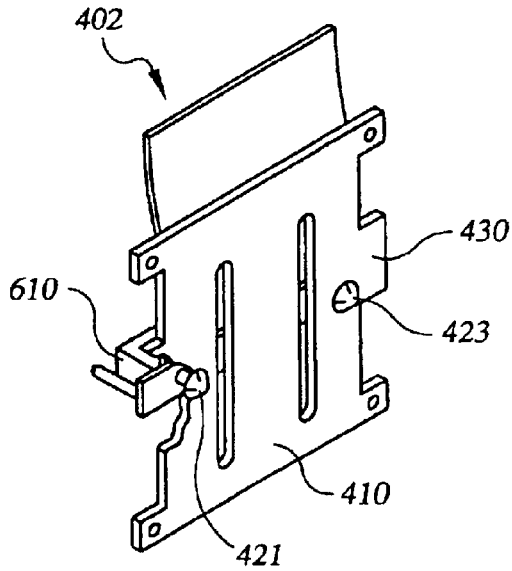
FIG. 5 is a partially cut-away, perspective view of the embodiments of the flex circuit assembly and support structure of FIG. 3, with the flex circuit assembly mounted to the support structure.
Figure 8:
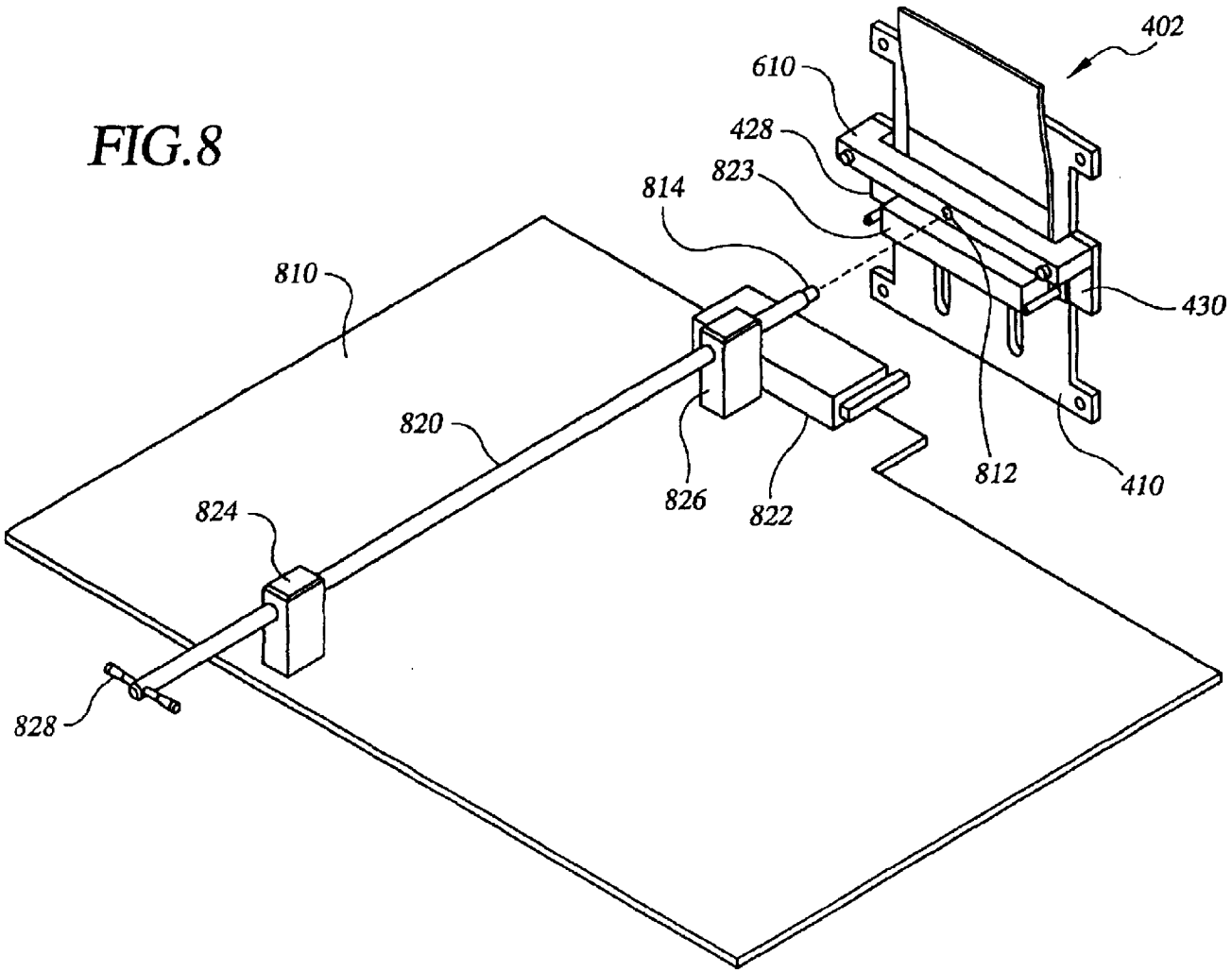
FIG. 8 is a partially cut-away, perspective view of an embodiment of a printed circuit board assembly aligned with an embodiment of a flex circuit assembly that is mounted to a support structure.

Also note in FIG. 5 that the support structure 410 includes protruding portions 428, 430 that extend outwardly from a centerline of the support structure. As shown in FIG. 8, protruding portions 428, 430 serve as mounts for an anchor 610. As will be described in detail below, the anchor 610 is configured to receive the distal end of a shaft that is used to align and engage the connector of the flex circuit assembly with a corresponding connector of an electronic component.

Figure 6:
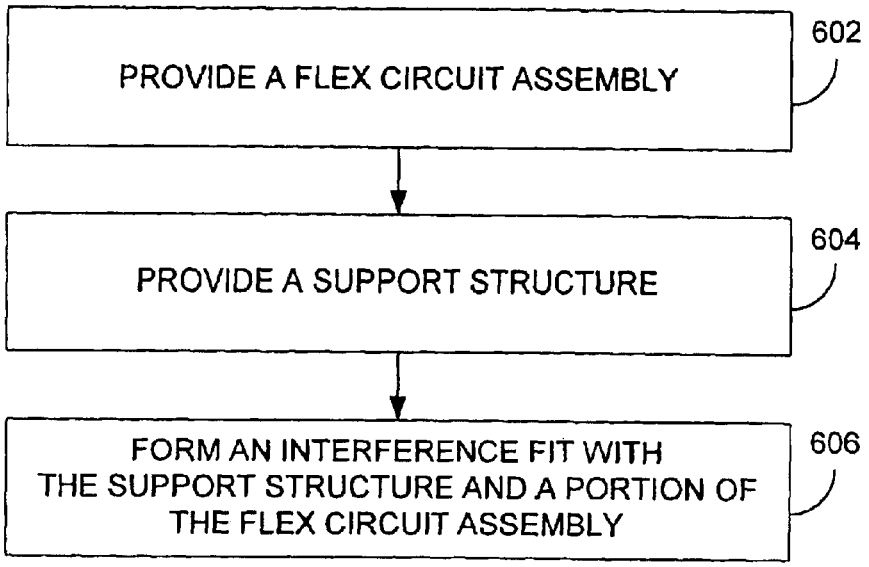
FIG. 6 is a flowchart depicting an embodiment of a method for electrically interconnecting components.

An embodiment of a method for electrically interconnecting components is depicted in the flowchart of FIG. 6. As shown in FIG. 6, the method may be construed as beginning at block 602, where a flex circuit assembly is provided. In block 604, a support structure is provided that is used to support at least a portion of the flex circuit assembly. In particular, as depicted in block 606, an interference fit is formed between the support structure and a portion of the flex circuit assembly. Typically, the portion of the flex circuit assembly forming the interference fit is located near a connector of the flex circuit assembly. This enables the connector to supported so that the connector is readily accessible for interconnecting with a corresponding connector of a component.

Figure 7:
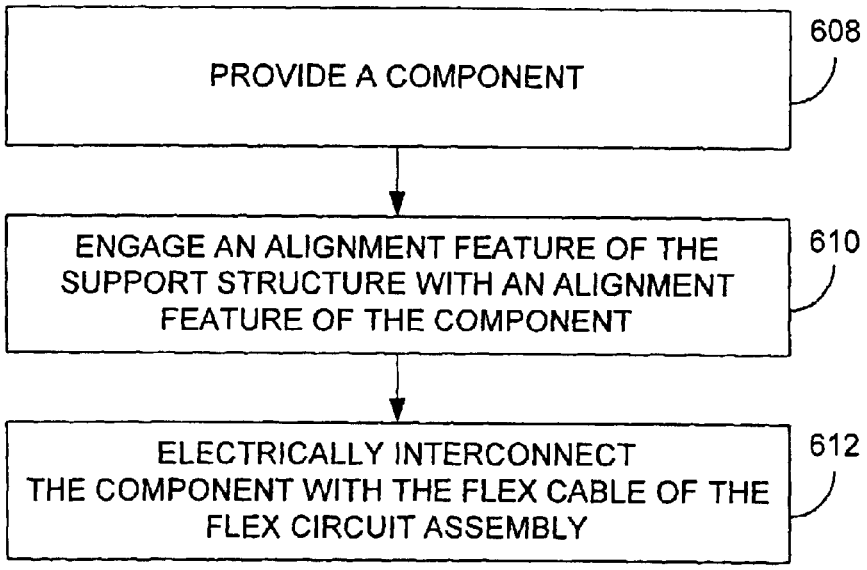
FIG. 7 is a flowchart depicting an embodiment of a method for electrically interconnecting components.

Continuing with the flowchart of FIG. 7, some embodiments of a method may further include providing a component, such as depicted in block 608. For instance, the component can be an electronic component such as a printed circuit board. In block 610, an alignment feature of the support structure is engaged with an alignment feature of the component. Note, representative alignment features will be described in detail later with respect to FIGS. 8 and 9. In block 612, the component is electrically interconnected with the flex cable of the flex circuit assembly. Specifically, engagement of the corresponding alignment features facilitates electrical interconnection of the component and the flex cable.

Reference is now made to FIG. 8, which depicts support structure 410 and flex circuit assembly 402 of FIG. 5 positioned for engaging a connector of a component. In particular, the component depicted is a PCB 810 that includes an alignment feature for engaging a corresponding alignment feature of the anchor 610. Note, the anchor 610 is generally configured as a bar that extends between the protruding portions 428, 430 of the support structure 410. The alignment feature anchor 610 is an orifice 812 located at an intermediate portion of the anchor. The alignment feature 812 is adapted to engage an alignment feature of PCB 810, which is configured as the distal end 814 of a shaft 820.

As shown in FIG. 8, shaft 820 extends generally across the PCB 810. The distal end 814 is located in a vicinity of connector 822, which is adapted to mate with the connector 823 of the flex circuit assembly 402. Mounts, e.g., mounting blocks 824, 826, are used to support the shaft 820 and allow the shaft to rotate so that the distal end 814 can engage within the orifice 812. In some embodiments, the distal end 814 and the orifice 812 are threaded so that when the distal end engages the orifice and the shaft is rotated, such as by use of a handle 828, rotation of the shaft draws the connectors 822, 823 into mating engagement with each other.

Note that in FIG. 8 the shaft 820 is located on the underside of PCB 810, i.e., the side that does not include the electrical traces and attached components. Clearly, the shaft could be located in various other positions. Typically, however, the shaft is located adjacent to the connector that is to engage the flex circuit assembly.

Figure 9:
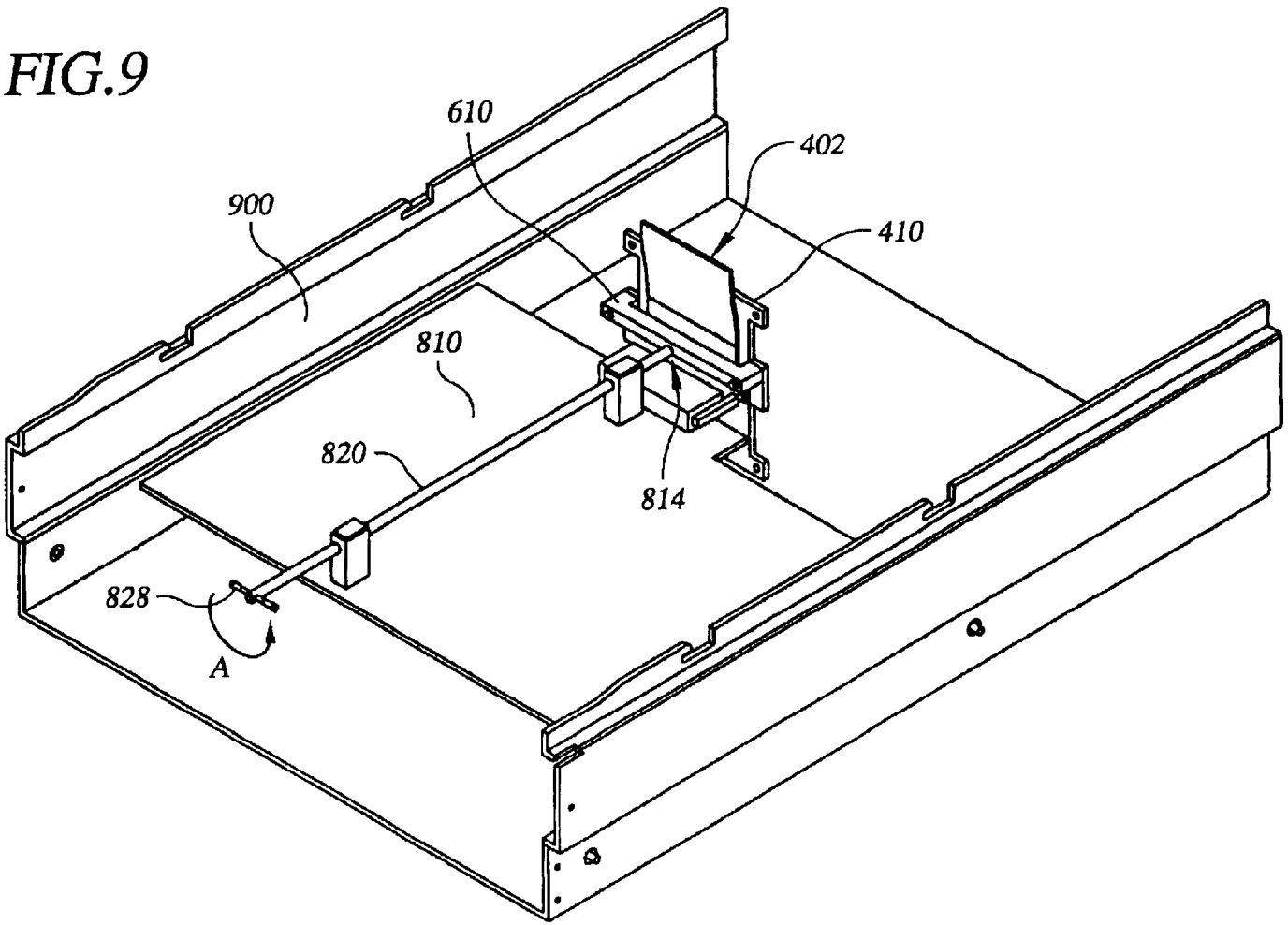
FIG. 9 is a partially cut-away, perspective view of a representative computer chassis mounting an embodiment of the printed circuit board assembly to a flex circuit assembly and associated support structure.

In FIG. 9, a portion of a representative chassis 900 is shown, in which component 810 is mounted. Specifically, component 810 is electrically interconnected with flex circuit assembly 402. Note that the flex circuit assembly 402 is located at a generally central portion of the interior of the chassis 900. This is a location that would be difficult for an operator to access by hand, particularly when a top cover of the chassis, which is not depicted in FIG. 10 for clarity, is installed. Typically, component 810 is supported within the chassis 900 by one or more of various support components (not shown), such as card guides or sliding rails, for example. Shaft 820 provides additional structural support for component 810 since, in the installed position depicted in FIG. 9, the shaft engages anchor 610, which is attached to support structure 410 of the chassis.

In order to remove component 810 from the chassis 900, an operator rotates handle 828, such as in the direction indicated by arrow A, to disengage the distal end 814 of the shaft from the anchor 610. After the shaft disengages the anchor, the component 810 and accompanying shaft can be slid out of the chassis. The component 810 can be remounted within the chassis by reversing the above-mentioned process.

It should be emphasized that the above-described embodiments of the present invention are merely possible examples of implementations set forth for a clear understanding of the principles of the invention. Many variations and modifications may be made to the above-described embodiments of the invention without departing substantially from the spirit and principles of the invention. By way of example, the embodiments described herein incorporate shafts with threaded distal ends that engage threaded orifices of corresponding support structures. However, in other embodiments, mechanical interfaces other than threads can be used. For instance, hardware that activates on quarter turn operation could be used. Additionally or alternatively, the single shaft structures described here could be substituted with various combinations of mechanical linkages, such as linkages that operate by rotation and/or longitudinal and/or transverse displacement. By way of example, an over-center draw latch, a level action assembly, or a cam action assembly could be used. As another example, the distal end of the shaft could include an orifice that receives an externally-threaded protrusion of the anchor.

All such modifications and variations are intended to be included herein within the scope of this disclosure and the present invention and protected by the following claims.

What is claimed is:

1. A system for electrically interconnecting components, said system comprising:

a flex cable assembly having a flex cable, a first connector and a retention member, the first connector being attached to and electrically interconnected with a first end of the flex cable, the retention member extending outwardly from the flex cable;

a support structure defining a first orifice and an anchor, the first orifice being sized and shaped to receive the retention member such that a portion of the retention member can be inserted into the orifice to form an interference fit, thereby mechanically supporting the flex cable assembly; and a printed circuit board (PCB) having a second connector, the second connector being sized and shaped to electrically interconnect with the first connector;

a first mount and a second mount attached to the PCB, the first mount having a second orifice and the second mount having a third orifice, the first mount and the second mount being spaced from each other and oriented such that the second orifice is aligned with the third orifice; and a shaft having a proximal end and an externally-threaded distal end, the shaft extending through the second orifice and the third orifice, the shaft being rotatably mounted to the PCB by the first mount and the second mount, the distal end being configured to engage the anchor of the support structure such that, as the distal end of the shaft engages the anchor and the shaft is rotated, the second connector is aligned with and moved toward mating engagement with the first connector.

2. The system of claim 1, wherein the anchor defines an internally-threaded orifice and the distal end of the shaft is sized and shaped to engage within the internally-threaded orifice.

3. The system of claim 1, wherein the second connector is mounted to the PCB adjacent to the distal end of the shaft.

4. The system of claim 1, wherein the retention member and the first orifice are sized and shaped to permit movement of the retention member when engaged in the interference fit.

5. The system of claim 1, wherein:

the PCB has a first outer edge and a second opposing outer edge;

the second connector is mounted adjacent to the second edge;

the second mount is located adjacent to the second connector; and the proximal end of the shaft is located adjacent to the first outer edge of the PCB.

6. The system of claim 1, further comprising:

a chassis in which at least one of the flex cable assembly, the support structure, and the PCB is mounted.

7. The system of claim 1, wherein the retention member has a post and a cap, the post having a first end located adjacent to the flex cable and as second end to which the cap is attached, the cap including multiple segments, each of which extends outwardly from the second end of the post, each of the segments being deflectable toward the post in response to a biasing force.

8. The system of claim 7, further comprising:

a plate mounted adjacent to the first connector, the retention member extending outwardly from the plate.

9. The system of claim 7, further comprising:

means for mounting the retention member adjacent to the first connector.

10. The system of claim 7, wherein the cap is generally dome-shaped.

11. The system of claim 10, wherein each of the segments is generally triangle-shaped.

12. The system of claim 7, wherein the retention member is a first retention member; and further comprising:

a second retention member extending outwardly from the flex cable, the second retention member having a post and a cap, the post having a first end located adjacent to the flex cable and as second end to which the cap is attached, the cap including multiple segments, each of which extends outwardly from the second end of the post, each of the segments being deflectable toward the post in response to a biasing force.

13. The system of claim 12, wherein the first and second retention members are mounted adjacent to the first connector.

* * * * *